United States Patent [19]

Ito et al.

[11] 3,978,696

[45] Sept. 7, 1976

[54] APPARATUS FOR CONTINUOUSLY RELAXING A TEXTILE FABRIC

[75] Inventors: Shyogo Ito, Kaga; Hiroshi Mizutani, Mie, both of Japan

[73] Assignees: Teijin Limited, Osaka; Kitanippon Dyeing & Finishing Co., Ltd.; Nippon Dyeing Machine Manufacturing Co., Ltd., all of Japan

[22] Filed: Apr. 29, 1975

[21] Appl. No.: 572,722

[30] Foreign Application Priority Data

May 11, 1974 Japan ..... 49-51743

[52] U.S. Cl. ..... 68/158; 68/184; 68/207; 226/42; 226/44

[51] Int. Cl.[2] ..... D06B 3/10

[58] Field of Search ..... 68/43, 44, 62, 158, 68/175, 177, 181 R, 183, 184, 205 R, 207; 226/42, 44

[56] References Cited

UNITED STATES PATENTS

| | | | |
|---|---|---|---|
| 1,999,317 | 4/1935 | Brix | 68/177 X |
| 2,067,915 | 1/1937 | Haeberlin | 68/184 |
| 2,613,522 | 10/1952 | Heffelfinger | 68/62 |
| 2,712,977 | 7/1955 | Keggin | 68/181 R X |
| 3,700,404 | 10/1972 | Janisch et al. | 68/177 X |

FOREIGN PATENTS OR APPLICATIONS

| | | | |
|---|---|---|---|
| 1,267,726 | 6/1961 | France | 226/44 |
| 19,188 | 9/1972 | Japan | 68/181 R |
| 15,792 | 8/1963 | Japan | 68/183 |
| 18,047 | 6/1970 | Japan | 68/175 |
| 573,042 | 11/1945 | United Kingdom | 68/158 |
| 467,257 | 1937 | United Kingdom | 68/181 R |

*Primary Examiner*—Philip R. Coe
*Attorney, Agent, or Firm*—Burgess Ryan and Wayne

[57] ABSTRACT

A continuous relaxing apparatus for textile fabrics which comprises, in combination: a treating vessel; a lower open conveyer having numerous openings formed thereon and circulating along a closed lower path; an upper open conveyer having numerous openings formed thereon and circulating along a closed upper path, a narrow path for relaxing the fabric being formed between an upper portion of the closed lower path and a lower portion of the closed upper path; numerous nozzles for jetting a treating liquid therethrough, located outside of the narrow relaxing path; a feed roller for the fabric; a delivery roller for the fabric, and; recycling means for the treating liquid from the treating vessel to the nozzles; and includes the improvement which comprises, in combination: (1) an overflow vessel for containing the treating liquid therein, located above the treating vessel; (2) treating liquid recycling means from the treating vessel to the overflow vessel, and; (3) a duct for feeding the fabric into the narrow relaxing path, which has an upper inlet portion thereof extending upward through the bottom of the overflow vessel and terminated in the overflow vessel and a lower outlet portion thereof extending horizontally and terminated at the front of the narrow relaxing path, the duct allowing the treating liquid to carry the fabric through the duct and introduce the fabric into the narrow relaxing path.

4 Claims, 4 Drawing Figures

APPARATUS FOR CONTINUOUSLY RELAXING A TEXTILE FABRIC

The present invention relates to an apparatus for continuously relaxing a textile fabric, more particularly, relates to an apparatus for continuously relaxing shrinking and washing a textile fabric within a treating liquid bath.

It is known from Japanese Patent Application Laying-Open No. 48-1486 and Japanese Patent Application Publication No. 49-8836, that a textile fabric can be continuously relaxed by an apparatus which comprises, in combination: (A) a treating vessel for containing therein a treating liquid and a textile fabric to be treated with the treating liquid; (B) a lower open conveyer having numerous openings formed thereon and circulating along a closed lower path formed in the treating vessel, the closed lower path having an upper portion thereof extending horizontally; (C) an upper open conveyer having numerous openings formed thereon and circulating along a closed upper path formed above the closed lower path, the closed upper path having a lower portion thereof, facing the upper portion of the closed lower path and forming, between the upper portion of the closed lower path and the lower portion of the closed upper path, a narrow path in which the fabric is relaxed; (D) numerous nozzles for jetting the treating liquid toward the narrow relaxing path through the numerous openings of portions of the lower and upper open conveyers respectively located in the upper portion of the closed lower path and the lower portion of the closed upper path; (E) a roller for feeding the fabric into the treating vessel; (F) a roller for delivering the fabric from the treating vessel, and; (G) means for recycling the treating liquid from the treating vessel to the nozzles.

In the above type of apparatus, the feeding operation of the fabric is carried out by way of gravity feed from the feed roller toward the front of the narrow relaxing path. The front of the narrow relaxing path is beneath the normal level of the treating liquid in the treating vessel and a portion of the treating liquid is jetted through the nozzles and flows from the inside of the narrow relaxing path toward the front thereof. This direction of the flow of the treating liquid not only hinders introduction of the fabric into the narrow relaxing path but also blows up the fabric toward the treating liquid surface. This causes an uneven introduction of the fabric. The uneven introduction results in uneven relaxing of the fabric and uneven quality of the resultant relaxed fabric.

Accordingly, in order to uniformly relax the fabric, it is important that the fabric be uniformly introduced into the narrow relaxing path.

The object of the present invention is to provide an apparatus for continuously relaxing a textile fabric, which is capable of smoothly and uniformly feeding the fabric into the relaxing operation.

The above object can be attained by the apparatus of the present invention.

The apparatus of the present invention comprises, in combination:

a. a treating vessel for containing therein a treating liquid and a textile fabric to be treated with the treating liquid;

b. a lower open conveyer having numerous openings formed thereon and circulating along a closed lower path formed in said treating vessel, the closed lower path having an upper portion thereof extending horizontally;

c. an upper open conveyer having numerous openings formed thereon and circulating along a closed upper path formed above the closed lower path, the closed upper path having a lower portion thereof facing the upper portion of the closed lower path and formng, between the upper portion of the closed lower path and the lower portion of the closed upper path, a narrow path in which the fabric is relaxed;

d. numerous nozzles, for jetting the treating liquid toward the narrow relaxing path, located outside of the narrow relaxing path along the upper portion of the closed lower path and the lower portion of the closed upper path;

e. a roller for feeding said fabric into said treating vessel;

f. a roller for delivering said fabric from said treating vessel, and;

g. means for recycling said treating liquid from said treating vessel to said nozzles; and includes the improvement which comprises, in combination:

1. an overflow vessel, for containing a portion of the treating liquid, located above the treating vessel;
2. means for recycling a portion of the treating liquid from the treating vessel to the overflow vessel;
3. a duct for feeding the fabric into the narrow relaxing path, the duct having an upper inlet portion extending upwardly through the bottom of the overflow vessel and terminated in the overflow vessel to allow the treating liquid in the overflow vessel to overflow into said duct and carry the fabric through the duct, and a lower outlet portion extending horizontally and terminated at the front of the narrow relaxing path to allow the treating liquid to be discharged horizontally and to carry the fabric into the narrow relaxing path.

The apparatus of the present invention can be operated by the process which comprises the steps of:

a. feeding a treating liquid into a treating vessel;

b. circulating a lower open conveyer, which is located in the treating vessel and has numerous openings formed thereon, at a predetermind velocity along a closed lower path having an upper portion thereof extending horizontally, in a predetermined direction;

c. circulating an upper open conveyer, which is located above the lower open conveyer, at a predetermined velocity, along a closed upper path having a lower portion thereof facing the upper portion of the closed lower path in a direction that of the lower open conveyer;

d. introducing a textile fabric into a narrow textile path formed between the lower portion of the closed upper path and the upper portion of the closed lower path, at a velocity higher than that of the circulating velocity of the lower open conveyer, to allow the textile fabric in the narrow relaxing path to be in a tensionless condition;

e. recycling the treating liquid from the treating vessel to numerous nozzles located outside of said narrow relaxing path along the lower portion of the closed upper path and the upper portion of the closed lower path;

f. jetting the treating liquid from the numerous nozzles toward the fabric in the narrow relaxing path through numerous openings formed on the upper and lower open conveyers, and;

g. delivering the fabric from the narrow relaxing path; and includes the improvement which comprises:

1. recycling a portion of the treating liquid from the treating vessel to an overflow vessel located above the treating vessel;
2. feeding the fabric into a duct having an upper inlet portion thereof extending upwardly through the bottom of the overflow vessel and terminating in the overflow vessel and a lower outlet portion therof extending horizontally and terminating at the entrance portion of the narrow relaxing path, and;
3. overflowing a portion of the treating liquid from the overflow vessel into the duct over the upper inlet end thereof, to allow the treating liquid to carry the fabric through said duct into the entrance portion of the narrow relaxing path.

The features and advantages of the present invention will be more apparent after reading the description set forth in detail hereinafter with reference to the accompanying drawings, in which.

Figure 1:
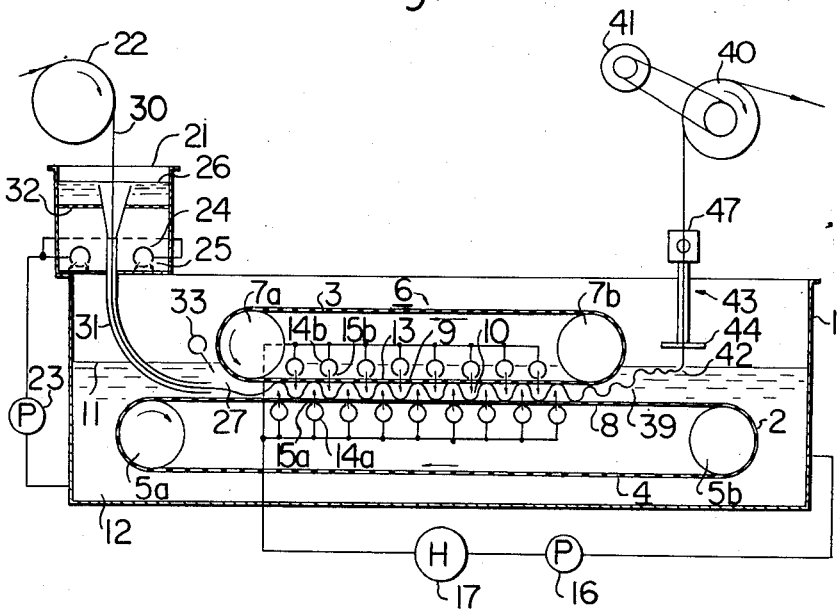
FIG. 1 is a schematic explanatory side view of an embodiment of the apparatus of the present invention.

Referring to FIG. 1, a treating vessel 1 contains therein a lower open conveyer 2 and an upper open conveyer 3. The lower open conveyer 2 can circulate along a closed lower path 4 formed around a pair of rotating wheels 5*a* and 5*b*. The upper open conveyer 3 can circulate along a closed upper path 6 formed around a pair of rotating wheels 7*a* and 7*b*. The closed lower path 4 has an upper portion 8 therof extending horizontally between the wheels 5*a* and 5*b*. The closed upper path 6 has a lower portion 9 thereof facing the upper portion 8 of the closed lower path 4 and extending between the wheels 7*a* and 7*b*. Between the upper portion 8 of the closed lower path 4 and the lower portion 9 of the closed upper path 6, a narrow space is formed. This narrow space is referred to as a narrow relaxing path 10. The closed lower path 4 resides entirely beneath the normal level 11 of the treating liquid 12, and the lower portion 9 of the closed upper path 6 also resides beneath the normal level 11. Accordingly, the narrow relaxing path is filled with the treating liquid. The thickness of the narrow relaxing path 10 can be determined in response to the type of the fabric to be treated, the velocity of the fabric when it is moving through the path 10 and the temperature of the treating liquid. Generally, the thickness is between about 20 mm to about 60 mm, preferably, between about 30 mm to about 50 mm. The lower and upper open conveyers 2 and 3 have numerous openings 13 formed thereon. Numerous lower nozzles 14*a* are arranged outside of the narrow relaxing path 10 along the upper portion 8 of the closed lower path 4. Also, numerous upper nozzles 14*b* are arranged outside of the narrow relaxing path 10 along the lower portion 9 of the closed upper path 6. The lower nozzles 14*a* have openings 15*a* directed upward and the upper nozzles 14*b* have openings 15*b* directed downward. As is seemed in FIG. 1, the lower nozzles 14*a* and the upper nozzles 14*b* do not face each other.

A portion of the treating liquid is recycled to the lower and upper nozzles 14*a* and 14*b* through a pump 16 and a heater 17 by which the treating liquid is heated to a desired temperature. When the treating liquid is recycled to the nozzles 14*a* and 14*b*, the recycled treating liquid is jetted from the openings 15*a* and 15*b* into the narrow relaxing path 10 through the openings 13 of the lower and upper open conveyers 2 and 3.

An overflow vessel 21 is located above the treating vessel 1. A rotatable feed roller 22 is located above the overflow vessel 21. The overflow vessel 21 is connected to the treating vessel 1 through a pump 23 so as to recycle a portion of the treating liquid from the treating vessel 1 to the overflow vessel 21. The recycled treating liquid is distributed uniformly to the overflow vessel 21 through distributing pipes 24 laying along the bottom of the vessel 21. The pipes 24 have numerous openings 25 formed at the bottoms thereof. Accordingly the recycled treating liquid is blown downward through the openings 25 so that the level of the treating liquid in the overflow vessel 21 rises uniformly and waving of the treating liquid surface 26 is prevented.

In order to feed a fabric 30 into the narrow relaxing path 10, a duct 31 is located between the feed roller 22 and the front 27 of the narrow relaxing path 10. An upper inlet portion of the duct 31 extends upward through the bottom of the overflow vessel 21 and terminates at the normal level of the treating liquid in the overflow vessel 21. A lower outlet portion of the duct 31 extends horizontally and terminates at the front 27 of the narrow relaxing path 10. Accordingly, the portion of the treating liquid which has been recycled into the overflow vessel 21, overflows over the top of and into the duct 31 and is discharged horizontally through the outlet portion of the duct 31 into the narrow relaxing path 10.

The fabric 30 moving down from the feed roller 22 is received in the upper inlet of the duct 31, carried through the duct 31 by the stream of the treating liquid and, then, discharged horizontally at the front 27 of the narrow relaxing path 10. Accordingly, the fabric 30 can be smoothly introduced into the narrow relaxing path by the horizontal stream of the treating liquid, in spite of the stream of the treating liquid flowing from the inside of the narrow relaxing path 10 toward the front of the narrow relaxing path 10.

In order to smoothly introduce the fabric 30 into the narrow relaxing path 10, it is important to prevent air being sucked into the duct 31. If air is introduced into the duct 31 together with the overflow of the treating liquid, the air is discharged in the form of bubbles together with the treating liquid and floats up together with the fabric 30 toward the surface of the treating liquid in the treating vessel 1. This floating hinders the smooth introduction of the fabric 30 into the narrow reflaxing path 10. In order to uniformly overflow the treating liquid into the duct 31 without introduction of air, it is required that the treating liquid regularly flows up through the overflow vessel 21 and the surface of the treating liquid be maintained smooth, i.e. without waves. In order to regulate the overflow of the treating liquid, means 32 for restricting the flow of the treating liquid through the overflow vessel 21 may be disposed between the pipes 24, that is, the inlet for recylcing the treating liquid, of the overflow vessel 21, and the overflow level of the treating liquid in the overflow vessel 21. The restricting means 32 may be composed of one or more nets or perforated plates.

By feeding the fabric 30 with the stream of the treating liquid through the duct 31, the fabric 30 can be smoothly and uniformly introduced into the narrow relaxing path 10. In order to assist the smooth introduction of the fabric 30, a plurality of nozzles 33 may be aligned above the front of the narrow relaxing path 10.

Figure 2:
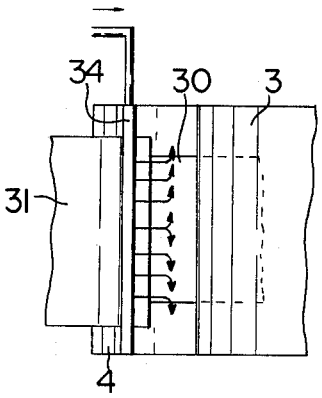
FIG. 2 is a schematic explanatory plane view of the entrance portion of the apparatus of FIG. 1.

Referring to FIG. 2, the nozzles 33 may be composed of a pipe 34 having a plurality of openings through which the treating liquid is jetted toward the front of the narrow relaxing path 10. A portion of the treating liquid is recycled from the treating vessel 1 to the pipe 34. If the treating liquid is jetted through the openings in the directions shown by arrows in FIG. 2, the jetted streams of the treating liquid act so as to open the fabric 30 in the lateral direction thereof while assisting the introduction of the fabric 30 into the narrow relaxing path. The nozzles 33 may be located either above or beneath the normal level 11 of the treating liquid in the treating vessel 1. However, aligning the nozzles 33 above the normal level 11 is preferable for effectively assisting the introduction of the fabric.

Referring to FIG. 1, the fabric 30 is fed by the feed roller 22 at a velocity higher than that of the circulating velocity of the lower open conveyer 2. Accordingly, the fabric 30 is placed in a corrugated form in a tensionless condition on the lower open conveyer 2, and carried along the narrow relaxing path 10 by circulating the lower and upper open conveyers 2 and 3 in directions shown by arrows in FIG. 1. The upper open conveyer 3 may be circulted at the same velocity as that of the lower open conveyer 2. Also, the upper open conveyer 3 may be circulated at a different velocity from that of the lower open conveyer 2 as long as the fabric can be smoothly carried along the narrow relaxing path 10. The treating liquid is jetted from the openings 15*a* and 15*b* of the nozzles 14*a* and 14*b* toward the fabric 30 in the narrow relaxing path 10 through the openings 13 of the lower and upper open conveyers 2 and 3.

Figure 3:
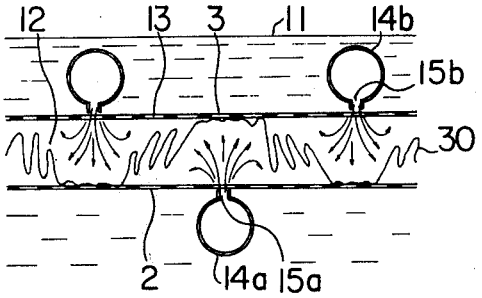
FIG. 3 is an explanatory cross-sectional view of the relaxing portion of the apparatus of FIG. 1.

Referring to FIG. 3, the nozzles 14*a* located under the lower open conveyer 2 do not face the nozzles 14*b* located above the upper open conveyer 3. Accordingly, a portion of the fabric 30 located right above the nozzle 14*a* is impacted by the jet from the nozzle 14*a* and pressed upwardly onto the upper open conveyer 3. Also, another portion of the fabric 30 located right below the nozzle 14*b* is impacted by the jet from the nozzle 14*b* and pressed downwardly onto the lower open conveyer 2. By the action of the jets, the fabric 30 is completely relaxed while moving through the narrow relaxing path 10. In the relaxing operation, when the openings of the conveyers come to the front of the openings of the nozzles, the jets from the nozzles can pass through the opening of the conveyers and impact the fabric. However, when the portions of the conveyers other than the openings thereof come to the front of the nozzles, the jets from the nozzles can not pass through the conveyers, and the fabric is released from the impact. This type of intermittent impact operation produces complex turbulent flows of the treating liquid in the narrow relaxing path. Such turbulent flows are effective for promoting the relaxing operation for the fabric.

Referring to FIG. 1, after the fabric 30 passes through the narrow relaxing path 10, the fabric 30 is delivered from the rear 39 of the narrow relaxing path 10 to the outside of the treating vessel 1 by means of a delivery roller 40. The delivery roller 40 is driven by a motor 41.

In order to smoothly deliver the fabric 30 from the treating vessel 1, it is preferable that the fabric 30 be drawn upward along a normal delivery path between the rear 39 of the narrow relaxing path 10 and the delivery roller 40. However, sometimes, the fabric is withdrawn upward from the treating vessel before the fabric reaches the front of the normal delivery path or after the fabric passes through the front of the normal delivery path. Such irregular delivering operation causes uneven quality of the relaxed fabric and entanglement of the fabric in the rear of the narrow relaxing path. In order to avoid the irregular delivering operation, it is preferable that means 43 for adjusting the velocity of the motor 41, by which the delivery roller 40 is driven, is disposed between the delivery roller 40 and the rear 39 of the narrow relaxing path 10.

Figure 4:
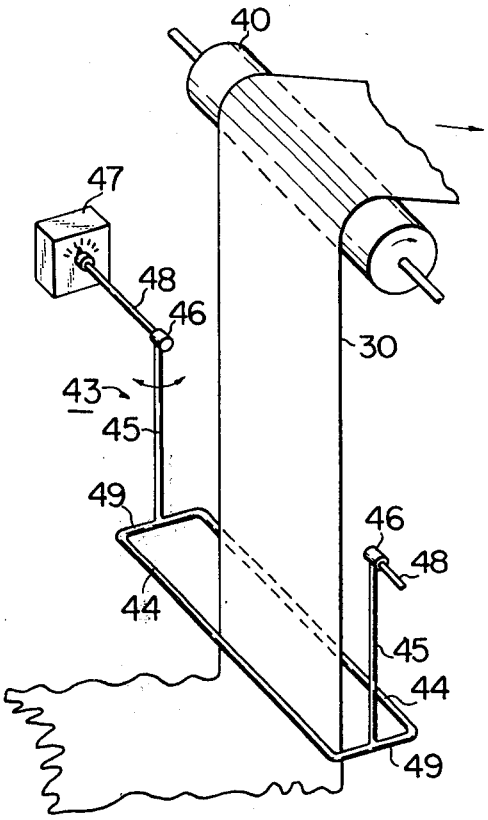
FIG. 4 is an explanatory perspective view of an embodiment of means for adjusting the delivery velocity of a fabric, of the apparatus of the present invention.

Referring to FIGS. 1 and 4, the adjusting means 43 comprises, in combination:

1. a pair of detecting bars 44 extending in parallel to each other in a plane at right angles to the normal delivery path of the fabric;
2. a pair of hangers 45 supporting the detecting bars 44, the hangers 45 being pivotable around the top ends 46 thereof;
3. means 47 for detecting the rotational angle of the hangers, and;
4. means (not shown in FIGS. 1 and 4) for adjusting the velocity of the motor 41 in response to the detected value of the rotational angle of the hangers.

The detecting bars 44 may be connected to each other through a pair of bars 49 so as to form a long rectangular frame, and the hangers 45 may be connected at lower ends thereof to the rectangular frame formed by the bars 44 and 49. The top ends 46 of the hangers 45 are fixed to supporting members 48. One of the supporting members 48 is connected to the rotational angle detecting means 47 and is capable of rotating with the hanger 45 to which it is attached. Referring to FIGS. 1 and 4, when the fabric 30 is withdrawn along the normal delivery path from the rear 39 of the narrow relaxing path 10, the fabric 30 does not touch the detecting bars 44. Under these circumstances, the motor 41 rotates at a normal velocity, and the fabric 30 is withdrawn at a normal velocity by the delivery roller 40.

If the fabric is withdrawn upward after the fabric passes through the front of the normal delivery path, a delivery path is formed at the right side (in FIGS. 1 and 4) of the normal path. In this delivering operation, the detecting bar 44 is pulled right (in FIGS. 1 and 4) by the fabric 30. Accordingly, the hangers 45 are rotated to the right (in FIGS. 1 and 4). The rotational angle of the hangers 45 is detected by the detecting means 47. The velocity of the motor 41 is increased in response to the detected value of the right rotational angle and, accordingly, the fabric 30 is delivered by the delivery roller 40 at an increased velocity.

When the fabric is withdrawn before the fabric comes to the front of the normal delivery path, a delivery path is formed at the left side (FIGS. 1 and 4) of the normal path. In this left delivery path, the fabric 30 pulls the detecting bars 44 to the left (in FIGS. 1 and 4). As a result, the velocity of the motor 41 is decreased in response to the detected value of the left rotational angle of the hangers 45, and, accordingly, the fabric 30 is delivered by the delivery roller 40 at a decreased velocity.

By utilizing the apparatus and method of the present invention, the fabric can be uniformly and smoothly relaxed, the relaxed fabric has a uniform quality and the relaxing operation can be carried out easily, stably and rapidly. The apparatus and method of the present invention can also be utilized for continuously washing the fabric under a tensionless condition.

What we claim is:

1. An apparatus for continuously relaxing a textile fabric comprising, in combination:

a. a treating vessel for containing a treating liquid and a textile fabric to be treated with said treating liquid;

b. a lower open conveyer having numerous openings formed thereon and movable along a closed lower path formed in said treating vessel, said closed lower path having a horizontally extending upper portion;

c. an upper open conveyer having numerous openings formed thereon and movable along a closed upper path formed above said closed lower path, said closed upper path having a lower portion facing said upper portion of said closed lower path whereby a narrow path in which said fabric is relaxed is formed between said upper portion of said closed lower path and said lower portion of said closed upper path;

d. a plurality of first nozzles, for jetting said treating liquid toward said narrow relaxing path, said nozzles being located outside of said narrow relaxing path along said upper portion of said closed lower path and said lower potion of said closed upper path;

e. a roller for feeding said fabric into said treating vessel;

f. a roller for delivering said fabric from said treating vessel;

g. means for recycling said treating liquid from said treating vessel to said nozzles;

h. an overflow vessel for containing a portion of said treating liquid, located above said treating vessel;

i. means for recycling a portion of said treating liquid from said treating vessel to said overflow vessel;

j. a duct for feeding said fabric into said narrow relaxing path, said duct having an upper inlet portion extending upwardly through the bottom of said overflow vessel and terminating in said overflow vessel to allow said treating liquid in said overflow vessel to overflow into said duct and carry said fabric through said duct, and a lower outlet portion coupled to said inlet portion and extending horizontally and terminating at one end of said narrow relaxing path to allow said treating liquid to be discharged horizontally and to introduce said fabric into said narrow relaxing path; and k. a plurality of second nozzles aligned above said one end of said narrow relaxing path and above the normal level of said treating liquid in said treating vessel, for jetting a plurality of streams of said treating liquid toward said one end of said narrow relaxing path for assisting the smooth introduction of said textile fabric into said narrow relaxing path while opening said fabric in the lateral direction thereof.

2. An apparatus as claimed in claim 1, including means for restricting the flow of said treating liquid through said overflow vessel, said flow restricting means being disposed between the overflow level and an inlet for recycling the treating liquid, of said overflow vessel, said restricting means comprising at least one net or perforated plate.

3. An apparatus as claimed in claim 1, including means for adjusting the velocity of said delivery roller, said adjusting means being responsive to the location of a portion of said fabric emerging from the exit portion of said treating vessel and being located between said exit portion and said delivery roller and connected to a motor for driving said delivery roller.

4. An apparatus as claimed in claim 3 wherein said delivery roller velocity adjusting means comprises, in combination:

1. a pair of detecting bars extending parallel to each other in a plane at right angles to the normal delivery path of said fabric;

2. a pair of hangers for supporting the detecting bars, said hangers being pivotable around top ends thereof;

3. means for detecting the rotational angle of said hangers, and;

4. means for adjusting the velocity of said motor in response to the detected value of said rotational angle of said hangers.

* * * * *